US012245686B2

(12) United States Patent
Scott, Sr. et al.

(10) Patent No.: US 12,245,686 B2
(45) Date of Patent: Mar. 11, 2025

(54) PAINT BRUSH HANDLE WITH INTEGRATED GRIP PADS

(71) Applicant: The Wooster Brush Company, Wooster, OH (US)

(72) Inventors: John L. Scott, Sr., Wooster, OH (US); James M. Byrne, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 384 days.

(21) Appl. No.: 17/846,595

(22) Filed: Jun. 22, 2022

(65) Prior Publication Data

US 2022/0408908 A1 Dec. 29, 2022

Related U.S. Application Data

(60) Provisional application No. 63/214,028, filed on Jun. 23, 2021.

(51) Int. Cl.
*A46B 5/02* (2006.01)

(52) U.S. Cl.
CPC ..... *A46B 5/02* (2013.01); *A46B 2200/202* (2013.01)

(58) Field of Classification Search
CPC ..... A46B 5/026; A46B 2200/202
See application file for complete search history.

(56) References Cited

U.S. PATENT DOCUMENTS 4,751,762 A 6/1988 Meimeteas
5,398,369 A 3/1995 Heinzelman et al.
5,920,943 A 7/1999 Barker
6,195,830 B1 3/2001 Bruschi
6,401,290 B1 6/2002 Barton et al.
D464,802 S 10/2002 Woodnorth et al.
D470,316 S 2/2003 Schmidt et al.
D471,719 S 3/2003 Schmidt et al.
D478,730 S 8/2003 Goulet
D492,122 S 6/2004 Woodnorth et al.
D562,010 S 2/2008 Goulet et al.
D625,523 S 10/2010 Warner
D634,549 S 3/2011 Arvinte et al.
D638,223 S 5/2011 Arvinte et al.
8,060,972 B2 11/2011 Geiberger et al.
8,118,037 B2 2/2012 Cardenas et al.
9,155,381 B2 10/2015 Maslow et al.
9,986,817 B1 * 6/2018 Wesley ..... A46B 9/026
(Continued)

*Primary Examiner* — Andrew A Horton

(74) *Attorney, Agent, or Firm* — Renner, Otto, Boisselle & Sklar, LLP.

(57) ABSTRACT

A paint brush having a handle that includes integrated grip pad(s). The paint brush includes a handle and bristles operatively attached to the handle. The handle includes a major portion and grip pad(s) integrated with the major portion. The major portion of the paint brush handle may be made of a first material and the grip pad(s) may be made of a second material different from the first. The first material may have a greater elastic modulus or flexural modulus than the second material. The major portion of the handle includes pockets on opposite sides of the handle, and at least one through-hole extending between the pockets. Grip pad (s) may be over-molded into the pocket(s), which includes depositing a material of the grip pads into the pocket(s), resulting in a unitary structure of grip material extending through the through-hole(s).

19 Claims, 5 Drawing Sheets

(56) References Cited

U.S. PATENT DOCUMENTS

| | | | | |
|---|---|---|---|---|
| 2003/0005533 | A1* | 1/2003 | Woodnorth | B05C 17/0205 D4/138 |
| 2003/0172498 | A1 | 9/2003 | Polzin et al. | |
| 2004/0154133 | A1 | 8/2004 | Polzin et al. | |
| 2007/0163064 | A1 | 7/2007 | Wong et al. | |
| 2009/0139051 | A1 | 6/2009 | Hobbs | |
| 2010/0101037 | A1* | 4/2010 | Gross | B29C 37/0025 264/274 |
| 2010/0132731 | A1 | 6/2010 | Waitesmith | |
| 2011/0174328 | A1 | 7/2011 | Cerutti et al. | |
| 2014/0109928 | A1 | 4/2014 | Simard | |
| 2019/0110583 | A1 | 4/2019 | Duvall | |
| 2020/0352314 | A1 | 11/2020 | Battaglia | |

* cited by examiner

PAINT BRUSH HANDLE WITH INTEGRATED GRIP PADS

RELATED APPLICATIONS

This application claims the benefit of U.S. Provisional Application No. 63/214,028 filed Jun. 23, 2021, which is hereby incorporated herein by reference in its entirety.

TECHNICAL FIELD

The present invention relates generally to paint brushes, and more particularly to a paint brush having one or more integrated grip pads.

BACKGROUND

A paint brush is a type of brush commonly used to apply a coating, such as paint, sealants, or the like. A paint brush usually is made by clamping bristles to a handle with a ferrule. Paint brushes generally are available in various sizes, shapes, and materials depending on the desired application.

SUMMARY

An aspect of the present disclosure provides a paint brush having a handle that includes one or more integrated grip pads that enhance the comfort or ergonomics of the paint brush design.

According to an aspect of the present disclosure, a paint brush includes: a handle; and bristles operatively attached to the handle; wherein the handle includes a major portion and one or more grip pads integrated with the major portion, the major portion of the handle having a greater rigidity than the one or more grip pads.

In exemplary embodiments, the major portion of the handle and the grip pad(s) are made of different materials that provide the different rigidities. For example, the major portion may be made of wood and the one or more grip pads may be made of a resilient elastomer, such as a thermoplastic elastomer.

According to another aspect, a paint brush includes an elongated handle having a flat front face, a flat rear face, and left and right sides respectively connecting the flat front and rear faces; the respective flat front and rear faces each having a lower portion, an intermediate portion, and an upper portion; the respective lower portions being wider than the respective intermediate portions; and the flat front and rear faces each having a width that tapers from the lower portion toward the intermediate portion; bristles operatively attached to the lower portion of the handle with a ferrule; a front grip pad arranged in a recessed front pocket in the lower portion of the flat front face; and a rear grip pad arranged in a recessed rear pocket in the lower portion of the flat rear face; wherein: each of the front and rear grip pads is made with a resilient elastomeric material having a greater flexibility than respective regions of the lower portions that surround the front and rear grip pads; each of the front and rear grip pads has a perimeter with a wider lower portion and a narrower upper portion, in which the perimeter of each grip pad tapers from the wider lower portion toward the narrower upper portion; the perimeter of each of the front and rear grip pads defines a respective grip pad area, and each of the regions of the respective lower portions surrounding the front and rear grip pads defines a bezel area, the respective grip pad areas being greater than the respective bezel areas; and each of the front and rear grip pads includes a plurality of protrusions extending upright from a base of the respective grip pad, each of the plurality of protrusions being independently compressible and resiliently movable relative to each other.

According to another aspect, a method of forming a paint brush includes: providing a major portion of a handle having at least one pocket; over-molding at least one grip pad into the at least one pocket.

The following description and the annexed drawings set forth certain illustrative embodiments of the invention. These embodiments are indicative, however, of but a few of the various ways in which the principles of the invention may be employed. Other objects, advantages, and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
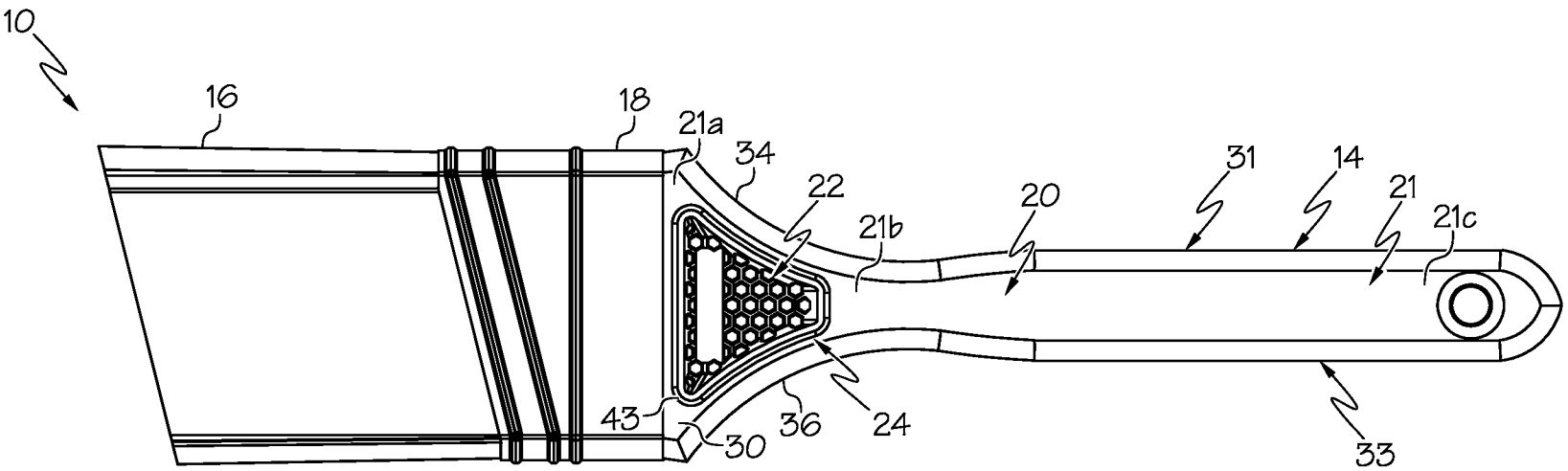
FIG. 1 is a front view of an exemplary paint brush according to an embodiment of the present disclosure.
Figure 2:
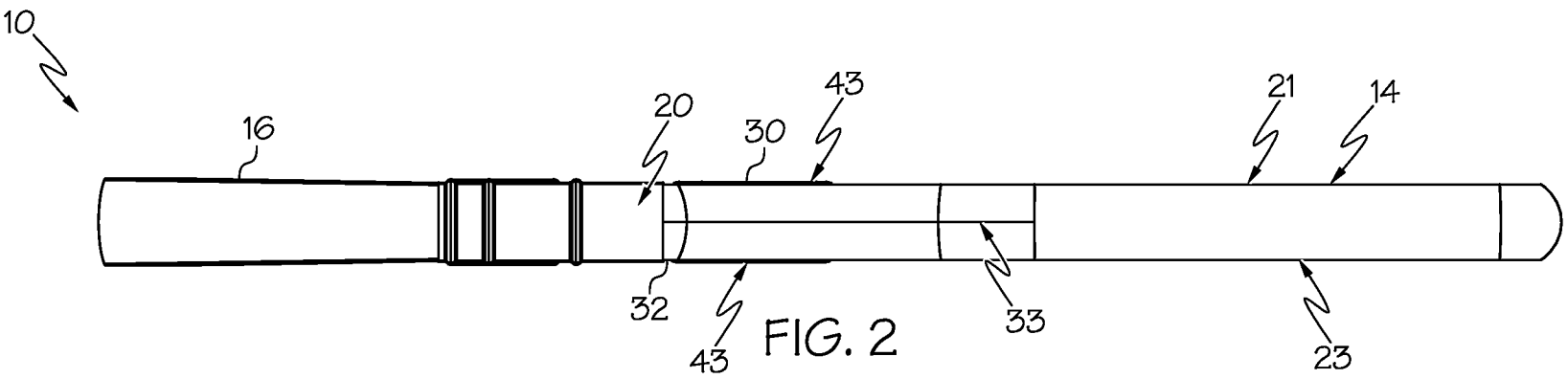
FIG. 2 is a left side view of the paint brush in FIG. 1.

Referring to FIGS. 1-5, an exemplary paint brush 10 according to an embodiment of the present disclosure is shown. The paint brush 10 generally includes a handle 14 and bristles 16 (also referred to as filaments 16) that are operatively coupled to the handle 14. The filaments 16 may be coupled to the handle 14 in any suitable manner, such as with a metal ferrule 18 in a conventional manner. For example, the filaments 16 may be set in a suitable adhesive, such as an epoxy, that extends into one or more outwardly protruding annular grooves in the inner wall of the ferrule 18 for securely fastening the filaments 16 to the ferrule 18. The filaments 16 may be provided in any shape or form as desired. In exemplary embodiments, the lower ends of the filaments 16 may be progressively longer across the lateral width of the brush 10 to provide an angled brush, such as typically used for trim work; or the lower ends of the filaments 16 may all be of substantially the same length if desired.

The paint brush 10 generally includes an elongated handle 14 having a flat front face 21, a flat rear face 23, and left and right sides 31, 33 respectively connecting the flat front and rear faces 21, 23. The respective flat front and rear faces 21, 23 each have a lower portion 21*a* proximate the bristles 16, an intermediate portion 21*b*, and an upper portion 21*c* distal the bristles 16. As shown, the respective lower portions 21*a* of the flat front and rear faces 21 and 23 proximate the bristles 16 may be wider than the respective intermediate portions 21*b*, and the flat front and rear faces 21 and 23 may each have a width that tapers from the lower portion 21*a* toward the intermediate portion 21*b*. The tapered surfaces may taper either in a continuous linear fashion, or in a curved fashion, as shown in FIG. 1.

The handle 14 includes a major portion 20 which may provide the main structural support of the handle 14 and the main gripping surface of the handle 14. Located on the opposite front and rear flat faces 21, 23 of the major portion 20 of the handle 14 are grip pads 22 integrated with the major portion 20, which in the illustrated embodiment are mirror images of each other. As shown, the grip pads 22 may constitute a large region of the major portion 20. For example, the perimeter of each of the front and rear grip pads 22 defines a respective grip pad area 43, and each of the regions of the respective lower portions 21*a* surrounding the front and rear grip pads 22 defines a bezel 30, 32 having a bezel area 24, in which the respective grip pad areas 43 are greater than the respective bezel areas 24. The grip pads 22 also may have a shape that corresponds to the shape of the lower portion 21*a* of the handle. For example, in the illustrated embodiment, the perimeter of each grip pad 22 tapers from the wider lower portion of the grip pad 22 toward the narrower upper portion of the grip pad 22.

The grip pad(s) 22 form discrete segments of the overall handle 14, which is/are operatively integrated to the major portion 20 in any suitable manner, including by way of mechanical features (mechanical fasteners, projections, etc.), adhesives, sonic welding, or the like. For example, the grip pads 22 may be bonded or fastened to the major portion 20 of the handle 14. Alternatively, the grip pad 22 could be formed as a continuous band around the major portion 20, such as within in a recess circumscribing the major portion 20. The grip pad(s) 22 may have any suitable configuration to provide improved comfort or ergonomics of the design. The grip pads 22 may have an exposed surface that is flush or essentially flush with the adjacent outer surface of the major portion 20. In the illustrated embodiment, the grip pads 22 on each flat face 21, 23 are the same configuration and same material, although it is understood the grip pads 22 could be provided with different configurations (shapes, locations, etc.) and/or different materials. As shown, the grip pads 22 are provided at the lower (enlarged) portion 21*a* of the handle 14 where the user's fingertips generally rest during a coating process.

In the illustrated embodiment, the grip pads 22 include a textured area including texturing 42. As shown, the grip pads 22 may include a rim 51 that surrounds the texturing 42. The textured area (texturing 42) may be recessed relative to an upper surface 53 of the rim 51 to provide a recessed area 40 relative to the rim 51 and/or flat faces 30, 32 of the handle 14. The grip pad 22 also may include a tapered surface 55 that extends inwardly from the rim 51 toward the base 45 of the at least one grip pad 22 and surrounds the textured area (texturing 42).

Figure 4:
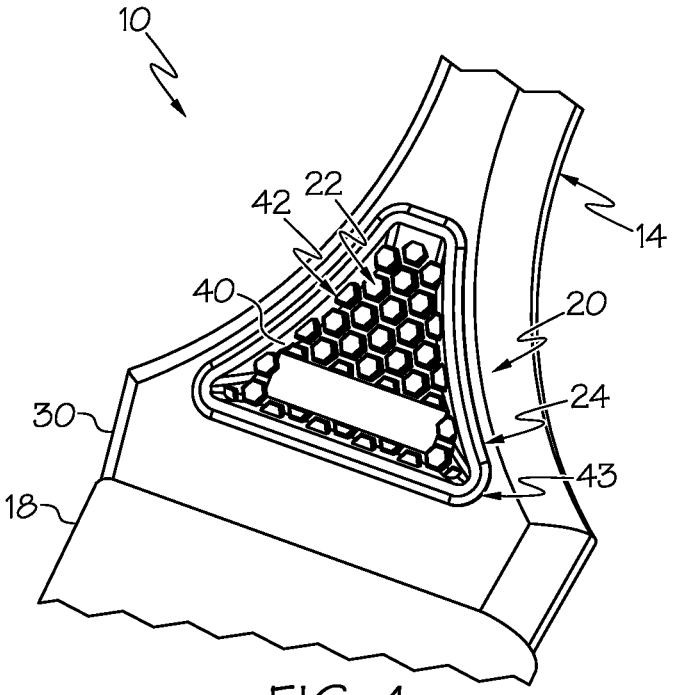
FIG. 4 is an enlarged perspective view of the exemplary grip pad installed in the pocket according to FIG. 3.
Figure 5:
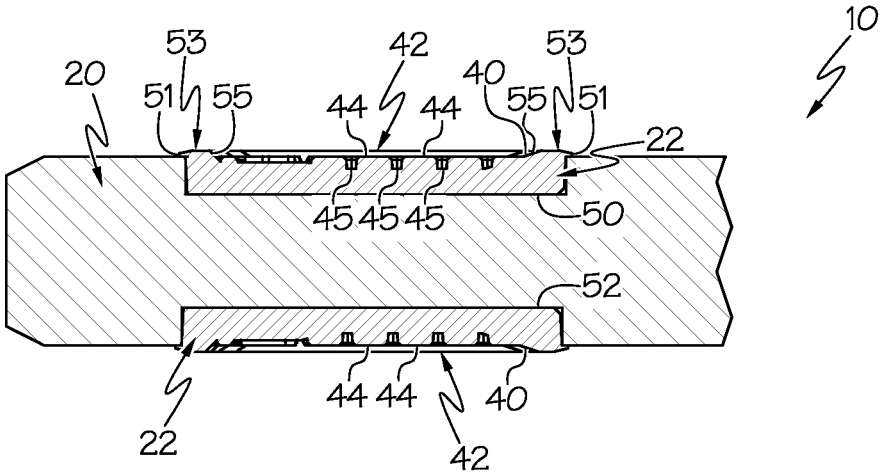
FIG. 5 is a cross-sectional side view of the paint brush and grip pad.
Figure 6:
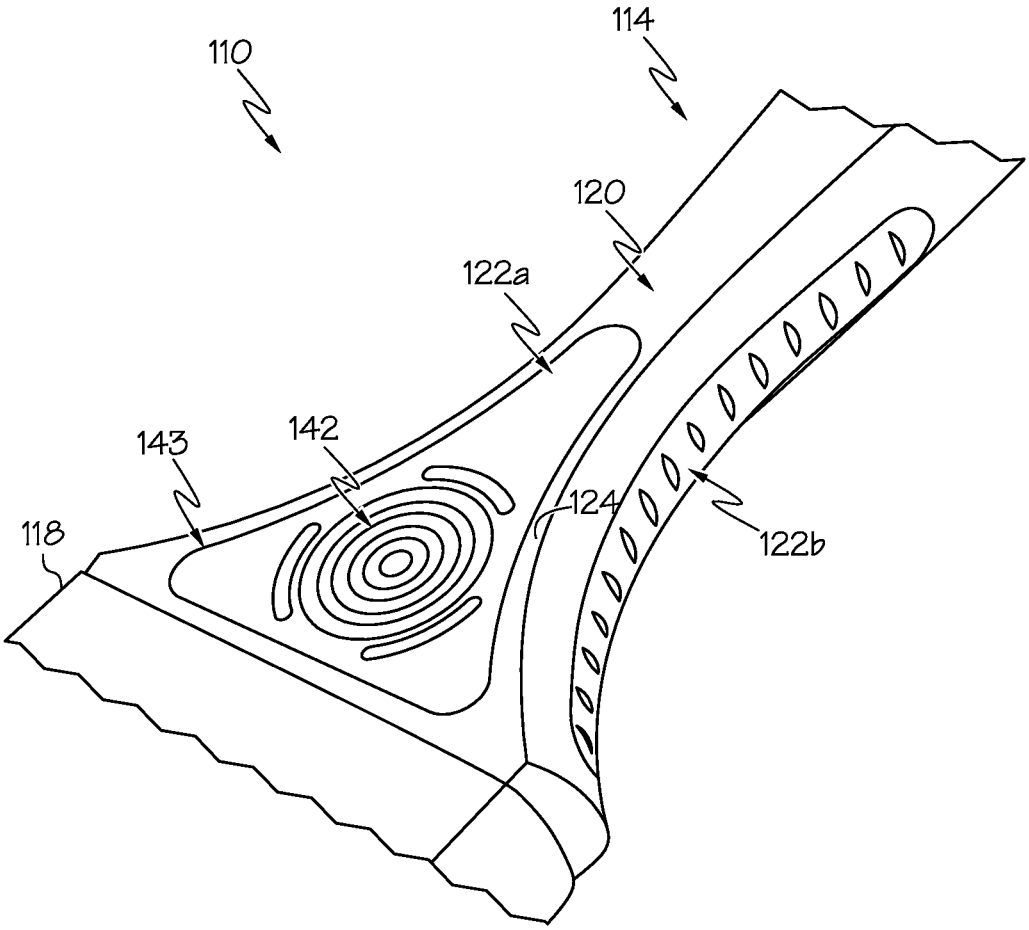
FIG. 6 is an enlarged perspective view of a portion of another exemplary paint brush according to another embodiment of the present disclosure.

The texturing 42 may be in any suitable form to provide a tactile feel and/or improve grip for the user. In the illustrated embodiment, the texturing 42 is in the form of discrete protrusions 44 extending upright from a base 45 of the recessed area 40 of the grip pad 22. The protrusions 44 may be at least partially or wholly surrounded by the bezel 30 of the major portion 20 of the handle 14. As shown, the upright protrusions 44 may have a flat upper surface and/or may be spaced apart from each other in a uniformly spaced array. To improve the tactile feel and/or grip, each of the plurality of protrusions 44 may be independently compressible and resiliently movable relative to each other. The protrusions 44 can be solid structures (as shown in FIGS. 4 and 5), hollow structures, post structures, annular ring-shaped structures nested within each other (as shown in FIG. 6), or a combination thereof, or any other suitable structure.

To integrate the grip pads 22 with the major portion 20, the grip pads 22 may be disposed in respective pockets 50, 52 in the lower portion 21*a* on opposite sides of the brush 10. The grip pads 22 may be attached in their respective pockets 50, 52 by adhesive. The pockets 50, 52 may include one or more holes 54 extending into the brush, improving the coupling of the pads 22 to the major portion 20. In exemplary embodiments, the grip pads 22 are made by a molding process, such as injection molding, or other suitable process, such as additive manufacturing, and are then operatively coupled within the pockets 50, 52 via a suitable technique, such as with mechanical features (mechanical fasteners, projections within the holes 54, etc.), adhesives, sonic welding, or the like. The holes 54 could also include an undercut or taper for mechanical securement; or could include an adhesive therein for bonding securement.

To couple the grip pads 22 together, holes 54 may be through-holes extending between the pair of pockets 50, 52, allowing opposite grip pads 22 to be operatively coupled together via the through hole(s) 54. In exemplary embodiments, the grip pad 22 material may be deposited (e.g. molded) into the respective pocket 50, 52 in such a way that the material flows into at least one through-hole 54 and grip pads 22 are formed in the two pockets 50, 52. In exemplary embodiments, the grip pads 22 are integrated with the major portion 20 of the handle 14 via an over-molding process. For example, the grip pads 22 may be directly formed via injection molding into the pockets 50, 52. During the injection molding process, the fluid material of the grip pads 22 may flow through the through-holes 54 to combine the grip pad material from opposite pockets 50, 52 and form a unitary structure upon cooling. This forms a strong coupling of the grip pads 22 with the major portion 20 and also minimizes the number of assembly steps.

Figure 3:
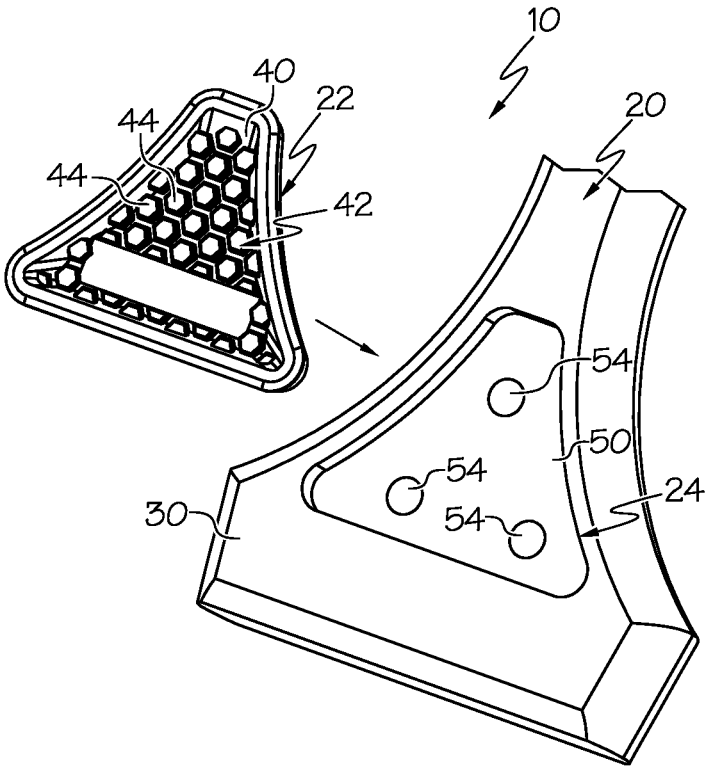
FIG. 3 is an enlarged exploded perspective view of the paint brush in FIG. 1, showing an exemplary grip pad and pocket in the paint brush.

The major portion 20 of the handle 14 may be made with any suitable material or combination of materials in any suitable manner to provide the desired structural support, stiffness, strength and/or overall shape of the handle 14 as may be desired for the particular application. In exemplary embodiments, the major portion 20 is made with suitable rigid polymer(s), wood, composite material, or combinations thereof. In the illustrated embodiment, for example, the major portion 20 is made of wood which is shaped by machining techniques into the desired overall shape. In alternative embodiments, the major portion 20 may be molded from thermoset or thermoplastic polymer, such as polypropylene (PP), polyamide (PA), polyoxymethylene (POM), or polycarbonate (PC), or any other suitable rigid plastic material, preferably which is impervious to many paint solvents. These rigid materials may generally have a rigidity (stiffness) that is greater than about 1 GPa, such as in a range from 1.0 GPa to about 20 GPa, as measured by elastic modulus or flexural modulus testing. For example, the elastic modulus of wood may be about 10 GPa, such as in a range from 10 GPa to 20 GPa. The flexural modulus of PP may be about 1.00 GPa (such as in a range from 1-2 GPa), or about 3 GPa to 10 GPa with glass fiber-reinforcement. The elastic modulus of PC may be about 2.00 GPa (such as in a range from 2-3 GPa); or about 3-7 GPa if blended with another polymer; or in a range of about 5-10 GPa with glass fiber-reinforcement. As shown in FIG. 3, for example, the major portion 20 is made of wood and the pockets 50, 52 are milled into each of the flat faces 30, 32. The pockets 50, 52 could include an undercut about its perimeter that holds the pads 22 in the pockets 50, 52.

The grip pad(s) 22 may be formed to have a greater flexibility and/or resiliency than the major portion 20 to enhance the comfort and/or ergonomics of the paint brush 10 design. For example, the major portion 20 may be made of a first material and the one or more grip pads 22 may be made of a second material different from the first material, wherein the first material has a greater elastic modulus or flexural modulus than the second material. This provides the major portion 20 of the handle 14 with greater rigidity than the one or more grip pads 22. The increased flexibility of the grip pad(s) 22 may at least partially be attributed to the type of material of the grip pad 22 which may have an elastic modulus or flexural modulus that is greater than that of the more rigid major portion 20.

In exemplary embodiments, the grip pad(s) 22 may be made of a flexible material, such as an elastomer (e.g., one or more resilient elastomeric materials). The grip pads 22 may be made of the same material, and each of the front and rear grip pads 22 may be made with a resilient elastomeric material having a greater flexibility than respective bezel regions 30, 32 of the lower portions 21*a* that surround the front and rear grip pads 22. For example, the grip pad(s) 22 may be made of a thermoplastic elastomer (TPE) material, including thermoplastic rubber (TPR), thermoplastic olefin (TPO), thermoplastic polyurethane (TPU) or thermoplastic vulcanizate (TPV), or any other suitable material or combinations of such materials. These flexible materials may generally have a flexibility that is at least an order of magnitude less than that of the rigid major portion 20, as measured by elastic modulus or flexural modulus testing. For example, the elastic modulus of a TPE may be in a range from about 4.0 MPa to about 200 MPa.

Figure 7:
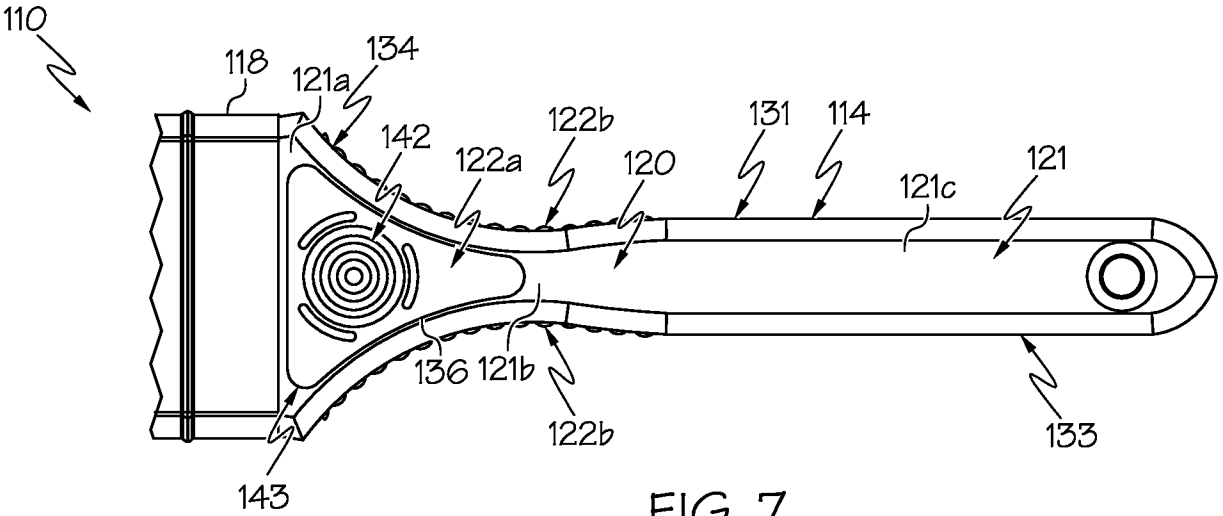
FIG. 7 is a partial front view of the paint brush in FIG. 6.
Figure 8:
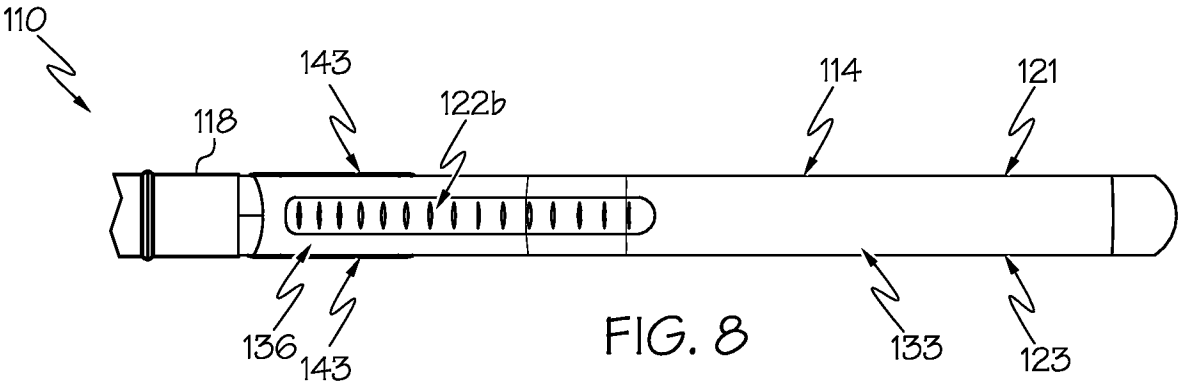
FIG. 8 is a partial left side view of the paint brush in FIG. 6.

Turning to FIGS. 6-8, another exemplary embodiment of a paint brush 110 having grip pads 122*a* integrated with a major portion 120 of the handle 114 is shown. The paint brush handle 114 is similar to the above-referenced paint brush handle 14, and consequently the same reference numerals but in the 100-series are used to denote structures corresponding to similar structures in the paint brush handles 14, 114. In addition, the foregoing description of the paint brush 10 is equally applicable to the paint brush 110, except as noted below. It is also understood that other aspects of the paint brushes 10, 110 may be substituted for one another or used in conjunction with one another where applicable.

In the illustrated embodiment, the grip pads 122*a* are on opposite sides of the paint brush 110, similarly to the paint brush 10, but include a different pattern of texturing 142. As shown, the texturing 142 of the paint brush 110 includes a plurality of concentric rings. Also as shown in the embodiment of FIGS. 6-8, the paint brush 110 includes additional grip pads 122*b* on the edges 134, 136 of the handle 114 (corresponding to edges 34, 36 of the handle 14 in FIG. 1). The grip pads 122*b* are formed integrally onto the wood major portion 120 of the handle through an insert molding process, which may include any of the foregoing coupling techniques such as over-molding, filling, adhering, fastening, or the like. The grip pads 122*b* include texturing such as a plurality of ridges as shown in FIG. 6.

Exemplary paint brush(es) have been shown and described herein, although it is understood that alterations or modifications may be provided based on the understanding of the present disclosure.

According to an aspect, a paint brush includes: a handle; and bristles operatively attached to the handle; wherein the handle includes a major portion and one or more grip pads integrated with the major portion, the major portion of the handle having a greater rigidity than the one or more grip pads.

Exemplary embodiments may include one or more of the following additional features, separately or in any combination.

In exemplary embodiment(s), the major portion is made of a first material and the one or more grip pads are made of a second material different from the first material, wherein the first material has a greater elastic modulus or flexural modulus than the second material, thereby providing the major portion of the handle with the greater rigidity than the one or more grip pads.

In exemplary embodiment(s), the first material has an elastic modulus in a range from about 1.0 GPa to about 20 GPa, and the second material has a flexural modulus in a range from about 10 MPa to about 250 MPa.

In exemplary embodiment(s), the one or more grip pads are made with a resilient elastomeric material.

In exemplary embodiment(s), the major portion is made of wood.

In exemplary embodiment(s), at least one grip pad of the one or more grip pads includes a plurality of protrusions extending upright from a base of the at least one grip pad, each of the plurality of protrusions being independently compressible and resiliently movable relative to each other.

In exemplary embodiment(s), the at least one grip pad includes a rim that surrounds the plurality of protrusions, and wherein each of the plurality of protrusions is recessed relative to an upper surface of the rim.

In exemplary embodiment(s), the at least one grip pad includes a tapered surface that extends inwardly from the rim to the base of the at least one grip pad and surrounds the plurality of protrusions.

In exemplary embodiment(s), each of the plurality of protrusions has a flat upper surface.

In exemplary embodiment(s), the plurality of protrusions are spaced apart from each other in a uniformly spaced array.

In exemplary embodiment(s), the plurality of protrusions are solid structures, hollow structures, post structures, annular ring-shaped structures nested within each other, or a combination thereof.

In exemplary embodiment(s), the grip pad is made of thermoplastic elastomer.

In exemplary embodiment(s), the major portion handle is elongated between an upper portion distal the bristles and a lower portion proximal the bristles, wherein the lower portion includes a laterally enlarged portion that is wider than the upper portion, and the major portion of the handle constitutes at least part of the laterally enlarged portion handle is laterally enlarged at a lower portion relative to a narrower upper portion, and wherein the one or more grip pads form discrete protrusions that are at least partially or wholly surrounded by the major portion of the handle.

In exemplary embodiment(s), the major portion constitutes a majority of the outer gripping surface of the handle.

In exemplary embodiment(s), the grip pads form discrete protrusions that are at least partially or wholly surrounded by the major portion of the handle.

In exemplary embodiment(s), the major portion of the handle majority includes a flat face having a width that tapers from a wider lower region of the handle to a narrower upper region of the handle, and wherein at least one of the one or more grip pads has a corresponding peripheral shape to that of the flat face of the major portion, in which a width of the at least one grip pad tapers from a wider lower portion of the grip pad to a narrow upper region of the grip pad.

In exemplary embodiment(s), the major portion includes one or more pockets and the one or more grip pads are disposed in the respective one or more pockets.

In exemplary embodiment(s), wherein the one or more grip pads are attached in the respective one or more pockets by adhesive.

In exemplary embodiment(s), the handle includes opposite front and rear flat faces, with opposite edges connecting the flat faces; and wherein the one or more grip pads includes two grip pads, one being located on the front flat face of the handle and the other being located on the opposite rear flat face of the handle, and wherein the grip pads are mirror images of each other.

In exemplary embodiment(s), the one or more grip pads are located toward the bristles in a laterally enlarged portion of the handle.

In exemplary embodiment(s), wherein the major portion includes one or more pockets and the one or more grip pads are disposed in the respective one or more pockets.

In exemplary embodiment(s), the one or more pockets includes one or more through-holes, and wherein the one or more grip pads are operatively coupled to the major portion by extending into the one or more through holes.

In exemplary embodiment(s), the major portion includes a pair of pockets on opposite sides of the brush; wherein one or more through-holes extend between the pair of pockets, and wherein a respective grip pad is disposed in each of the pockets, the respective grip pads being operatively coupled together via the one or more through holes.

In exemplary embodiment(s), the respective grip pads are operatively coupled together by adhesive or welding.

In exemplary embodiment(s), the major portion includes one or more through-holes extending between opposite sides of the handle; and wherein respective grip pads are disposed on the major portion and are joined together via the one or more through holes as a unitary structure.

In exemplary embodiment(s), the one or more grip pads have a recessed area relative to an outer surface of the major portion of the handle.

In exemplary embodiment(s), the one or more grip pads include texturing.

According to an aspect, a paint brush includes: an elongated handle having a flat front face, a flat rear face, and left and right sides respectively connecting the flat front and rear faces; the respective flat front and rear faces each having a lower portion, an intermediate portion, and an upper portion; the respective lower portions being wider than the respective intermediate portions; and the flat front and rear faces each having a width that tapers from the lower portion toward the intermediate portion; bristles operatively attached to the lower portion of the handle with a ferrule; a front grip pad arranged in a recessed front pocket in the lower portion of the flat front face; and a rear grip pad arranged in a recessed rear pocket in the lower portion of the flat rear face; wherein: each of the front and rear grip pads is made with a resilient elastomeric material having a greater flexibility than respective regions of the lower portions that surround the front and rear grip pads; each of the front and rear grip pads has a perimeter with a wider lower portion and a narrower upper portion, in which the perimeter of each grip pad tapers from the wider lower portion toward the narrower upper portion; the perimeter of each of the front and rear grip pads defines a respective grip pad area, and each of the regions of the respective lower portions surrounding the front and rear grip pads defines a bezel area, the respective grip pad areas being greater than the respective bezel areas; and each of the front and rear grip pads includes a plurality of protrusions extending upright from a base of the respective grip pad, each of the plurality of protrusions being independently compressible and resiliently movable relative to each other.

In exemplary embodiment(s), each of the front and rear grip pads includes a rim extending around the respective perimeter, and wherein each of the plurality of protrusions has a flat top that is recessed relative to an upper surface of the respective rim.

According to an aspect, a method of forming a paint brush includes: providing a major portion of a handle having at least one pocket; over-molding at least one grip pad into the at least one pocket.

In exemplary embodiment(s), wherein the major portion of the handle includes two pockets on opposite sides of the handle, and includes at least one through-hole extending between the two pockets; and wherein the over-molding includes depositing a material of the grip pads into the two pockets, such that the material flows into the at least one through-hole and grip pads are formed in the two pockets and are a unitary structure extending through the at least one through-hole.

According to an aspect, the ornamental design for a paint brush as shown and described with respect to any of FIGS. 1-8, in which any portion of the paint brush either via natural delineations or otherwise may be claimed or disclaimed.

As used herein, an "operative" connection, coupling, or the like; or a connection by which entities are "operatively" connected, is one in which the entities are connected in such a way that the entities may perform as intended. An operative connection may be a direct connection or an indirect connection in which an intermediate entity or entities cooperate or otherwise are part of the connection or are in between the operatively connected entities. An operative connection or coupling may include the entities being integral and unitary with each other.

It is to be understood that terms such as "top," "bottom," "upper," "lower," "left," "right," "front," "rear," "forward," "rearward," and the like as used herein may refer to an arbitrary frame of reference, rather than to the ordinary gravitational frame of reference.

It is to be understood that all ranges and ratio limits disclosed in the specification and claims may be combined in any manner, including all values, ranges and subranges between the stated values. It is to be understood that unless specifically stated otherwise, references to "a," "an," and/or "the" may include one or more than one, and that reference to an item in the singular may also include the item in the plural.

The term "about" as used herein refers to any value which lies within the range defined by a variation of up to +10% of the stated value, for example, +10%, +9%, +8%, +7%, +6%, +5%, +4%, +3%, +2%, +1%, +0.01%, or +0.0% of the stated value, as well as values intervening such stated values.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

The word "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," may refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The transitional words or phrases, such as "comprising," "including," "carrying," "having," "containing," "involving," "holding," "made from/of," and the like, are to be understood to be open-ended, i.e., to mean including but not limited to.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A paint brush comprising:

a handle including:

an upper elongated portion;

an intermediate portion;

a lower portion connected to the upper elongated portion via the intermediate portion, wherein the intermediate portion flares from the elongated portion to the lower portion;

one or more pockets formed in a surface of the handle and located in the intermediate portion;

bristles operatively attached to the lower portion of the handle;

one or more grip pads integrated with the handle, wherein:

each of the one or more grip pads are disposed in one of the one or more pockets;

each of the one or more grips pads has a triangular shape; and the handle has a greater rigidity than the one or more grip pads.

2. The paint brush according to claim 1, wherein the handle is made of a first material and the one or more grip pads are made of a second material different from the first material, wherein the first material has a greater elastic modulus or flexural modulus than the second material, thereby providing the handle with the greater rigidity than the one or more grip pads.

3. The paint brush according to claim 2, wherein the first material has an elastic modulus in a range from about 1.0 GPa to about 20 GPa, and the second material has a flexural modulus in a range from about 10 MPa to about 250 MPa.

4. The paint brush according to claim 3, wherein the one or more grip pads are made with a resilient elastomeric material.

5. The paint brush according to claim 4, wherein the handle is made of wood.

6. The paint brush according to claim 5, wherein at least one grip pad of the one or more grip pads includes a plurality of protrusions extending upright from a base of the at least one grip pad, each of the plurality of protrusions being independently compressible and resiliently movable relative to each other.

7. The paint brush according to claim 6, wherein the at least one grip pad includes a rim that surrounds the plurality of protrusions, and wherein each of the plurality of protrusions is recessed relative to an upper surface of the rim.

8. The paint brush according to claim 7, wherein the at least one grip pad includes a tapered surface that extends inwardly from the rim to the base of the at least one grip pad and surrounds the plurality of protrusions.

9. The paint brush according to claim 8, wherein each of the plurality of protrusions has a flat upper surface.

10. The paint brush according to claim 9, wherein the plurality of protrusions are spaced apart from each other in a uniformly spaced array.

11. The paint brush according to claim 10, wherein the plurality of protrusions are solid structures, hollow structures, post structures, annular ring-shaped structures nested within each other, or a combination thereof.

12. The paint brush according to claim 11, wherein the one or more grip pads form discrete protrusions that are at least partially or wholly surrounded by the handle.

13. The paint brush according to claim 12, wherein the handle includes a flat face having a width that tapers from the lower portion of the handle to the narrower upper elongated portion of the handle; and wherein at least one of the one or more grip pads has a corresponding peripheral shape to that of the flat face of the handle, in which a width of the at least one grip pad tapers from a wider lower portion of the grip pad to a narrow upper region of the grip pad.

14. The paint brush according to claim 1, wherein the one or more grip pads are attached in the respective one or more pockets by adhesive.

15. The paint brush according to claim 14, wherein the handle includes opposite front and rear flat faces, with opposite edges connecting the flat faces; and wherein the one or more grip pads includes two grip pads, one being located on the front flat face of the handle and the other being located on the opposite rear flat face of the handle, and wherein the grip pads are mirror images of each other.

16. A paint brush comprising:

an elongated handle having a flat front face, a flat rear face, and left and right sides respectively connecting the flat front and rear faces, wherein:

the respective flat front and rear faces each having a lower portion, an intermediate portion, and an upper portion;

the respective lower portions are wider than the respective intermediate portions; and the flat front and rear faces each having a width that tapers from the lower portion toward the intermediate portion;

bristles operatively attached to the lower portion of the handle with a ferrule;

a front grip pad arranged in a recessed front pocket in the intermediate portion of the flat front face; and a rear grip pad arranged in a recessed rear pocket in the intermediate portion of the flat rear face; wherein:

the front grip pad and the rear grip pad each have a triangular shape;

each of the front and rear grip pads is made with a resilient elastomeric material having a greater flexibility than respective regions of the lower portions that surround the front and rear grip pads;

each of the front and rear grip pads has a perimeter with a wider lower portion and a narrower upper portion, in which the perimeter of each grip pad tapers from the wider lower portion toward the narrower upper portion;

the perimeter of each of the front and rear grip pads defines a respective grip pad area, and each of the regions of the respective lower portions surrounding the front and rear grip pads defines a bezel area, the respective grip pad areas being greater than the respective bezel areas; and each of the front and rear grip pads includes a plurality of protrusions extending upright from a base of the respective grip pad, each of the plurality of protrusions being independently compressible and resiliently movable relative to each other.

17. The paint brush according to claim 16, wherein each of the front and rear grip pads includes a rim extending around the respective perimeter; and wherein each of the plurality of protrusions has a flat top that is recessed relative to an upper surface of the respective rim.

18. A method of forming a paint brush, comprising:

providing a handle having:

an upper elongated portion;

an intermediate portion;

a lower portion connected to the upper elongated portion via the intermediate portion, wherein the intermediate portion flares from the elongated portion to the lower portion;

at least one pocket formed in a surface of the handle and located in the intermediate portion;

attaching bristles to the lower portion of the handle via a ferrule configured to extend over a portion of the lower portion of the handle and a portion of the bristles; and adhesively attaching at least one grip pad into the at least one pocket, wherein each of the one or more grips pads has a triangular shape.

19. The method according to claim 18, wherein the at least one pocket includes two pockets; and wherein the intermediate portion of the handle includes the two pockets on opposite sides of the handle.

* * * * *